US005450646A

United States Patent [19]

McHugh et al.

[11] Patent Number: 5,450,646

[45] Date of Patent: Sep. 19, 1995

[54] POT WASHER

[76] Inventors: Hugh M. McHugh, 10056 Maclura Ct., Fairfax, Va. 22032; George Spector, 233 Broadway Rm 702, New York, N.Y. 10279

[21] Appl. No.: 280,152

[22] Filed: Jul. 25, 1994

[51] Int. Cl.[6] ..... A46B 13/02; A47L 17/04

[52] U.S. Cl. ..... 15/22.1; 15/23; 15/179; 15/186; 15/201; 366/347

[58] Field of Search ..... 15/22.1, 23, 24, 28, 15/29, 65, 70, 71, 72, 75, 76, 248.1, 179, 186, 201

[56] References Cited

U.S. PATENT DOCUMENTS

| | | | |
|---|---|---|---|
| 634,328 | 10/1899 | Freeman | 15/186 X |
| 1,501,020 | 7/1924 | Small | 15/248.1 |
| 3,251,086 | 5/1966 | Springer | 15/28 |
| 3,386,118 | 6/1968 | Morioku et al. | 15/201 |
| 3,407,431 | 10/1968 | Melnik | 15/23 |
| 4,137,588 | 2/1979 | Sandt et al. | 15/22.1 |
| 5,184,368 | 2/1993 | Holland | 15/201 |

FOREIGN PATENT DOCUMENTS

| | | | |
|---|---|---|---|
| 3635495 | 4/1988 | Germany | 15/23 |

*Primary Examiner*—Edward L. Roberts, Jr.

[57] ABSTRACT

A portable battery powered pot washing tool is provided, which consists of a gun-shaped housing having a handle. An electric motor having a shaft is within the housing. A waterproof battery is carried on a back end of the handle of the housing, to supply power to the motor. An on/off trigger switch is on a side of the handle of the housing and is electrically connected between the motor and the battery, to control the power to the motor. A collet having a release lever is carried on a front end of the housing. A brush attachment is coupled to the shaft within the collet and is operated by the motor for rotation, to clean various cooking utensils and similar articles.

2 Claims, 1 Drawing Sheet

POT WASHER

BACKGROUND OF THE INVENTION

The instant invention relates generally to a cleaning apparatus and more specifically it relates to a portable battery powered pot washing tool, which provides a mechanism for operating a brush attachment for cleaning various cooking utensils.

There are available various conventional cleaning apparatuses which do not provide the novel improvements of the invention herein disclosed.

SUMMARY OF THE INVENTION

A primary object of the present invention is to provide a portable battery powered pot washing tool that will overcome the shortcomings of the prior art devices.

Another object is to provide a portable battery powered pot washing tool that contains a mechanism for operating a brush attachment for cleaning various cooking utensils, such as pots, pans, deep glasses, vases and similar articles.

An additional object is to provide a portable battery powered pot washing tool, in which the battery is rechargeable and a storage unit mounted to a wall will hold the tool and brush attachments when not in use.

A further object is to provide a portable battery powered pot washing tool that is simple and easy to use.

A still further object is to provide a portable battery powered pot washing tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
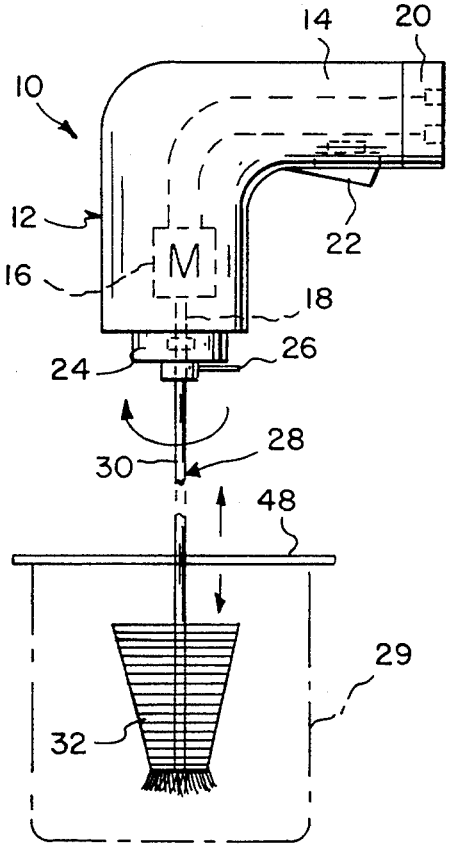
FIG. 1 is an elevational view of the instant invention in use.

Turning now descriptively to the drawings, in which similar reference characters denote similar elements throughout the several views, FIG. 1 illustrates a portable battery powered pot washing tool 10, which consists of a gun-shaped housing 12, having a handle 14. An electric motor 16 having a shaft 18 within. A waterproof battery 20 is carried on a back end of the handle 14 of the housing 12, to supply power to the motor 16.

An on/off trigger switch 22 on a side of the handle 14 of the housing 12 is electrically connected between the motor 16 and the battery 20, to control the power to the motor 16. A collet 24 having a release lever 26 is carried on a front end of the housing 12. A brush attachment 28 is coupled to the shaft 18 with the collet 24 and operated by the motor for rotation, to clean various cooking utensils 29 and similar articles.

The brush attachment 28 includes an elongated shank 30, having a first end that is coupled to the shaft 18 within the collet 24. A brush head 32 is at a second end of the shank 30 for cleaning.

Figure 2:
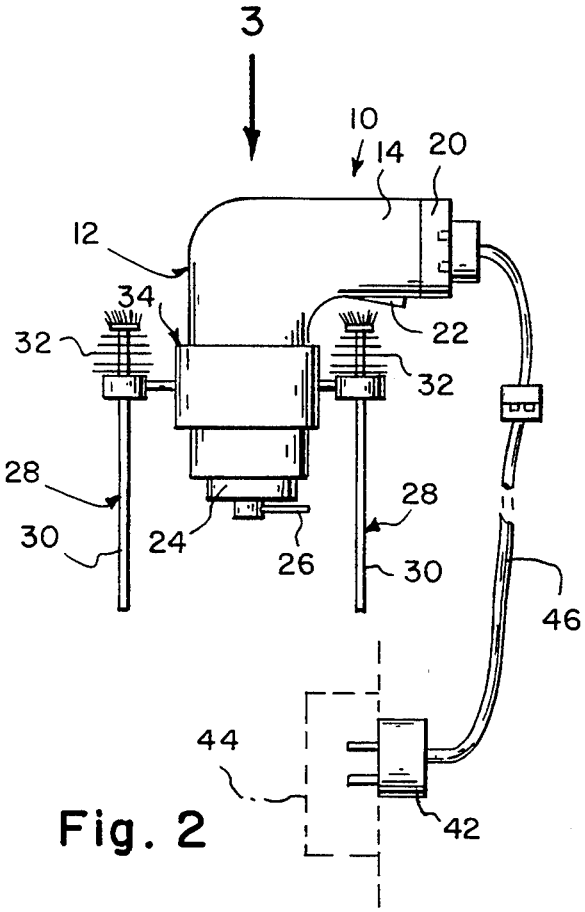
FIG. 2 is an elevational view showing the instant invention placed in a storage unit and electrically connected to a battery charger.
Figure 3:
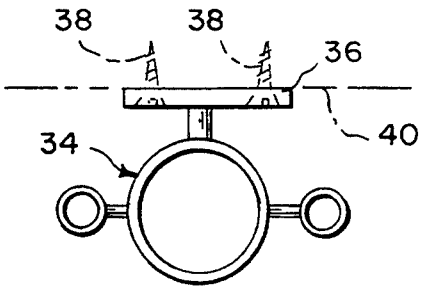
FIG. 3 is a top view of the storage unit per se taken in the direction of arrow 3 in FIG. 2.

FIGS. 2 and 3 show a storage unit 34, for holding the tool 10 and the brush attachment 28 when not in use. A mounting plate 36 is connected to the storage unit 34. A plurality of fasteners 38 are for securing the mounting plate 30 to a wall 40.

A battery charger 42 42 is shown in FIG. 2, that plugs into an electrical wall socket 44. A safety electric cord 46 extends from the battery charger 42 and plugs into the battery 20 for recharging.

An adjustable rubber gasket cover 48 in FIG. 1 fits onto the shank 30 of the brush attachment 28, so as to prevent back splash when cleaning.

Figure 4:
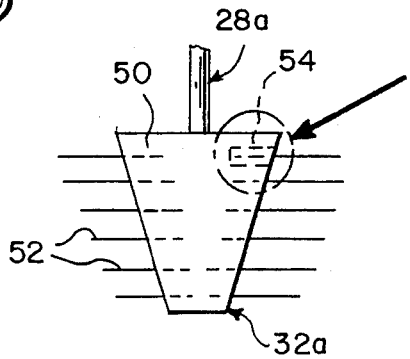
FIG. 4 is an elevational view of a modified brush attachment, in which its cone shaped head contains a plurality of collapsible bristles.
Figure 5:
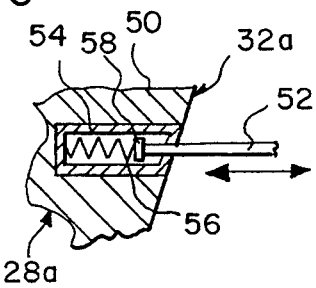
FIG. 5 is an enlarged cross sectional view as indicated by arrow 5 in FIG. 4, showing the internal structure of one collapsible bristle in the cone shaped head.

The brush head 32a of the brush attachment 28a in FIGS. 4 and 5, is a cone shaped member 50, having a plurality of spring biased collapsible bristles 52. Each bristle 52 is normally kept in an extended position from a sleeve 54 in the cone shaped member 50, by a spring 56 bearing against a stop 58 on an inner end of the bristle 52.

OPERATION OF THE INVENTION

To use the portable battery powered pot washing tool 10, a person simply grips the handle 14 and removes the housing 12 from the storage unit 14. The safety electric cord 46 is unpluged from the battery 20 after being charged by the battery charger 42. The adjustable rubber gasket cover 48 can be placed onto the shank 30 of the brush attachment 28. The shank 30 is then inserted into the collet 24, to couple to the shaft 18 of the motor 16. The brush head 32 is inserted into the cooking utensil 29 and the on/off trigger switch 32 is turned on. The brush head 32 will now rotate to clean the cooking utensil 29.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable battery powered pot washing tool which comprises:

a) a gun-shaped housing having a handle;

b) an electric motor having a shaft within said housing;

c) a waterproof battery carried on a back end of said handle of said housing, to supply power to said motor;

d) an on/off trigger switch on a side of said handle of said housing electrically connected between said motor and said battery to control the power to said motor;

e) a collet having a release lever carried on a front end of said housing;

f) a brush attachment coupled to said shaft within said collet and operated by said motor for rotation, to clean various cooking utensils and similar articles;

g) an elongated shank having a first end that is coupled to said shaft within said collet;

h) a brush head at a second end of said shank for cleaning;

i) a storage unit for holding said tool and said brush attachment when not in use;

j) a mounting plate connected to said storage unit;

k) a plurality of fasteners for securing said mounting plate to a wall;

l) a battery charger that plugs into an electrical wall socket;

m) a safety electric cord extending from said battery charger that plugs into said battery for recharging; further including an adjustable rubber gasket cover to fit onto said shank of said brush attachment, so as to prevent back splash when cleaning; wherein said brush head of said brush attachment is a cone shaped member having a plurality of spring biased collapsible bristles, which are each normally kept in an extended position from a sleeve in said cone shaped member by a spring bearing against a stop on an inner end of said bristle.

2. A portable battery powered pot washing tool which comprises:

a) a gun-shaped housing having a handle;

b) an electric motor having a shaft within said housing;

c) a waterproof battery carried on a back end of said handle of said housing, to supply power to said motor;

d) an on/off trigger switch on a side of said handle of said housing electrically connected between said motor and said battery to control the power to said motor;

e) a collet having a release lever carried on a front end of said housing;

f) a brush attachment coupled to said shaft within said collet and operated by said motor for rotation, to clean various cooking utensils and similar articles; wherein said brush head of said brush attachment is a cone shaped member having a plurality of spring biased collapsible bristles, which are each normally kept in an extended position from a sleeve in said cone shaped member by a spring bearing against a stop on an inner end of said bristle.

* * * * *